US008682186B2

(12) United States Patent
Ichikawa et al.

(10) Patent No.: US 8,682,186 B2
(45) Date of Patent: Mar. 25, 2014

(54) IMAGE FORMING DEVICE COMPRISING CHARGING DEVICE HAVING PLURAL DISCHARGE PORTIONS

(75) Inventors: Tomoya Ichikawa, Kanagawa (JP); Akiko Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 329 days.

(21) Appl. No.: 12/973,960

(22) Filed: Dec. 21, 2010

(65) Prior Publication Data

US 2011/0305471 A1 Dec. 15, 2011

(30) Foreign Application Priority Data

Jun. 11, 2010 (JP) ..... 2010-134337

(51) Int. Cl.
*G03G 15/02* (2006.01)

(52) U.S. Cl.
USPC ..... 399/50; 399/115; 399/168; 399/170; 399/227

(58) Field of Classification Search
USPC ..... 399/50, 53, 55, 115, 168, 170, 227
See application file for complete search history.

(56) References Cited

U.S. PATENT DOCUMENTS 5,365,325 A * 11/1994 Kumasaka et al. ..... 399/40
5,539,501 A * 7/1996 Yu et al. ..... 399/171
5,581,331 A * 12/1996 Teshigawara et al. ..... 399/171
5,613,172 A * 3/1997 Pietrowski et al. ..... 399/50
6,826,375 B2 * 11/2004 Kitajima ..... 399/50
8,295,723 B2 * 10/2012 Kobashi et al. ..... 399/50
2001/0024579 A1 * 9/2001 Onuki et al. ..... 399/50
2003/0016961 A1 * 1/2003 Kitajima ..... 399/50
2005/0226644 A1 * 10/2005 Ino ..... 399/50
2008/0069615 A1 * 3/2008 Shintani et al. ..... 399/346

FOREIGN PATENT DOCUMENTS

JP 5-158296 6/1993
JP 2010-44127 A 2/2010

OTHER PUBLICATIONS

Japanese Office Action dated Jan. 7, 2014 for corresponding Japanese Patent Application No. 2010-134337.

* cited by examiner

*Primary Examiner* — David Gray
*Assistant Examiner* — Francis Gray
(74) *Attorney, Agent, or Firm* — Sughrue Mion, PLLC

(57) ABSTRACT

An image forming device has: an image forming body on which an image is formed in a state in which the image forming body is charged; a charging device having plural discharge portions, and charging the image forming body by discharging of plural discharge portions; and a control section that, when forming the image on the image forming body, operates the plural discharge portions, and when not forming the image on the image forming body, switches between a state of operating some of the plural discharge portions and decreasing output of or stopping the discharge portions other than the some discharge portions, and a state of operating some other of the plural discharge portions and decreasing output of or stopping the discharge portions other than the some other discharge portions.

10 Claims, 13 Drawing Sheets

IMAGE FORMING DEVICE COMPRISING CHARGING DEVICE HAVING PLURAL DISCHARGE PORTIONS

CROSS-REFERENCE TO RELATED APPLICATION

This application is based on and claims priority under 35 USC 119 from Japanese Patent Application No. 2010-134337, filed on Jun. 11, 2010.

BACKGROUND

Technical Field

The present invention relates to an image forming device.

SUMMARY

A first aspect of the present invention is an image forming device having: an image forming body on which an image is formed in a state in which the image forming body is charged; a charging device that has plural discharge portions, and charges the image forming body by discharging of the plural discharge portions; and a control section that, when forming the image on the image forming body, operates the plural discharge portions, and when not forming the image on the image forming body, switches between a state of operating some of the plural discharge portions and decreasing output of or stopping the discharge portions other than the some discharge portions, and a state of operating some other of the plural discharge portions and decreasing output of or stopping the discharge portions other than the some other discharge portions.

BRIEF DESCRIPTION OF THE DRAWINGS

Exemplary embodiments of the present invention will be described in detail based on the following figures, wherein.

DETAILED DESCRIPTION

Examples of exemplary embodiments relating to the present invention are described hereinafter on the basis of the drawings.

Structure of Image Forming Device Relating to Present Exemplary Embodiment

Figure 1:
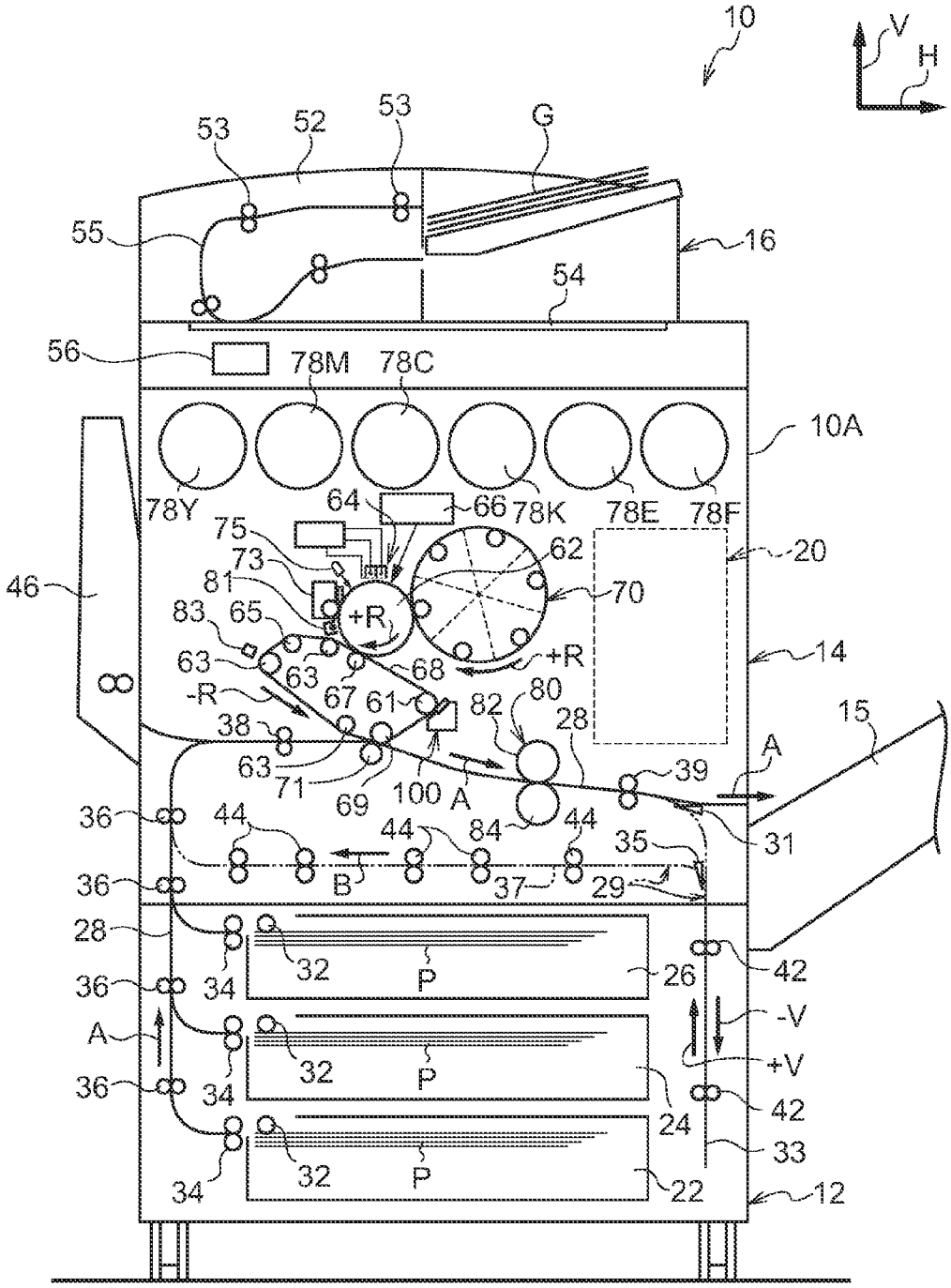
FIG. 1 is a schematic drawing showing the structure of an image forming device relating to an exemplary embodiment.

First, the structure of an image forming device relating to the present exemplary embodiment is described. FIG. 1 is a schematic drawing showing the structure of the image forming device relating to the present exemplary embodiment.

An image forming device 10 is structured to include: a sheet accommodating section 12 in which are accommodated recording sheets P that serve as examples of recording media; an image forming section 14 that is provided above the sheet accommodating section 12 and carries out image formation on the recording sheets P that are supplied from the sheet accommodating section 12; a document reading section 16 that is provided above the image forming section 14 and reads a document G to be read; and a control section 20 that is provided within the image forming section 14 and controls the operations of the respective sections of the image forming device 10. Note that, in the following description, the vertical direction of a device main body 10A of the image forming device 10 is called the arrow V direction, and the horizontal direction is called the arrow H direction.

A first accommodating section 22, a second accommodating section 24 and a third accommodating section 26, in which the recording sheets P of different sizes are accommodated, are provided at the sheet accommodating section 12. A feed-out roller 32, that feeds the accommodated recording sheet P out to a conveying path 28 provided within the image forming device 10, is provided at each of the first accommodating section 22, the second accommodating section 24 and the third accommodating section 26. A pair of conveying rollers 34 and a pair of conveying rollers 36, that convey the recording sheets P one-by-one, are provided at the downstream sides of the feed-out rollers 32 at the conveying path 28. Further, registration rollers 38, that temporarily stop the recording sheet P and send the recording sheet P out at a set timing to a secondary transfer position that is described below, are provided at the conveying path 28 at the downstream side of the conveying rollers 36 in the conveying direction of the recording sheets P.

When viewed from the front surface of the image forming device 10, the upstream side portion of the conveying path 28 is provided rectilinearly along the arrow V direction from the left side of the sheet accommodating portions 12 to the left side lower portion of the image forming section 14. Further, the downstream side portion of the conveying path 28 is provided from the left side lower portion of the image forming path 14 to a sheet ejecting section 15 that is provided at the right side surface of the image forming section 14. A double-sided (duplex printing) conveying path 29, at which the recording sheet P is conveyed and inverted in order to carry out image formation on both surfaces of the recording sheet P, is connected to the conveying path 28.

When viewed from the front surface of the image forming device 10, the double-sided conveying path 29 has: a first switching member 31 at which switching of the conveying path 28 and the double-sided conveying path 29 is carried out; an inverting portion 33 that is provided rectilinearly in the arrow V direction from the right side lower portion of the image forming section 14 to the right side of the sheet accommodating portions 12; a conveying portion 37 into which the trailing end of the recording sheet P conveyed at the inverting portion 33 is inserted and conveyed in the arrow H direction; and a second switching member 35 at which switching of the inverting portion 33 and the conveying portion 37 is carried out. Further, pairs of conveying rollers 42 are provided at plural locations and at intervals at the inverting portion 33, and pairs of conveying rollers 44 are provided at plural locations and at intervals at the conveying portion 37.

The first switching member 31 is a member that is shaped as a triangular pillar, and switches the conveying direction of the recording sheet P by the distal end portion thereof being moved to either one of the conveying path 28 or the double-sided conveying path 29 by an unillustrated driving device. Similarly, the second switching member 35 is a member shaped as a triangular pillar, and switches the conveying direction of the recording sheet P by the distal end portion thereof being moved to either one of the inverting portion 33 or the conveying portion 37 by an unillustrated driving device. Note that the downstream side end portion of the conveying portion 37 is connected, by an unillustrated guiding member, to a region just before the conveying rollers 36 that are at the upstream side portion of the conveying path 28. Further, a collapsible manual sheet feed portion 46 is provided at the left side surface of the image forming section 14. The recording sheet P can be conveyed from the manual sheet feed portion 46 to the registration rollers 38 of the conveying path 28.

Provided at the document reading section 16 are: a document conveying device 52 that conveys, one-by-one, the document G to be read; a platen glass 54 that is disposed beneath the document conveying device 52 and on which the document G to be read is placed; and a document reading device 56 that reads the document G to be read that is conveyed by the document conveying device 52 or the document G to be read that is placed on the platen glass 54. The document conveying device 52 has a conveying path 55 at which plural pairs of conveying rollers 53 are disposed. A portion of the conveying path 55 is disposed such that the recording sheet P passes on the platen glass 54. Further, in a state of being stationary at the left end portion of the platen glass 54, the document reading device 56 reads the document G to be read that is conveyed by the document conveying device 52. Or, while moving in the arrow H direction, the document reading device 56 reads the document G to be read that is placed on the platen glass 54.

On the other hand, a photoreceptor 62, that is shaped as a cylinder and serves as an example of an image forming body on which an image is formed in a state in which the image forming body is charged, is provided in the image forming section 14 at the central portion of the device main body 10A. The photoreceptor 62 is rotated in an arrow +R direction (clockwise in FIG. 1) by an unillustrated driving device, and holds electrostatic latent images that are formed by the irradiation of light. A scorotron charging device 64, that charges the surface of the photoreceptor 62, is provided at a position that is above the photoreceptor 62 and that faces the outer peripheral surface of the photoreceptor 62. The concrete structure of the charging device 64 is described below.

An exposure device 66 is provided at a position that is downstream of the charging device 64 in the rotating direction of the photoreceptor 62, and that faces the outer peripheral surface of the photoreceptor 62. On the basis of image signals corresponding to respective toner colors, the exposure device 66 irradiates (exposes) light and forms electrostatic latent images on the outer peripheral surface of the photoreceptor 62 that is charged by the charging device 64.

A rotating-switching type developing device 70 is provided at the downstream side, in the rotating direction of the photoreceptor 62, of the region at which the exposure light of the exposure device 66 is irradiated. The developing device 70 develops and makes the electrostatic latent images, that are formed on the outer peripheral surface of the photoreceptor 62, visible by toners of determined colors.

Figure 2:
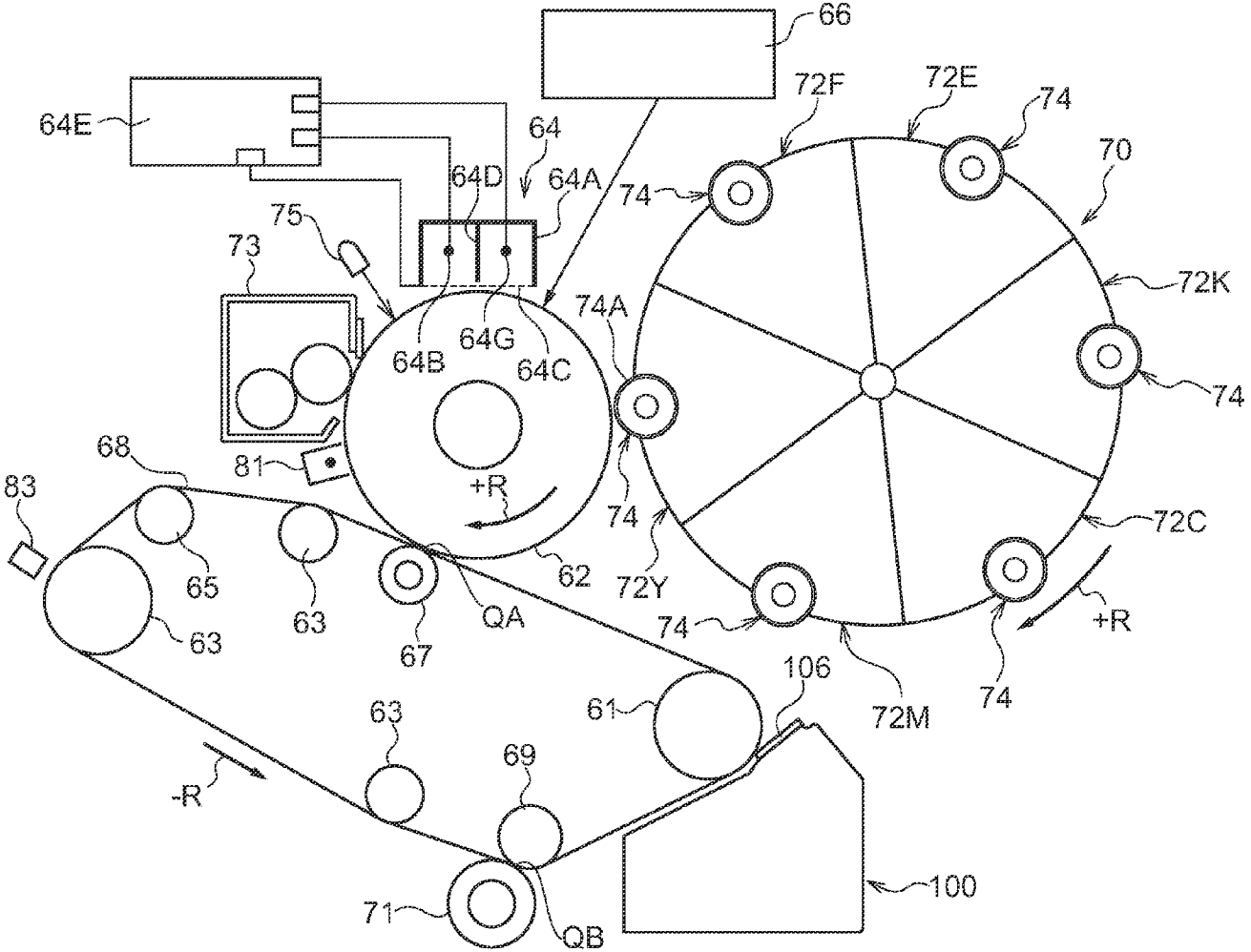
FIG. 2 is a schematic drawing showing structures at the periphery of a photoreceptor relating to the present exemplary embodiment.

As shown in FIG. 2, at the developing device 70, developing units 72Y, 72M, 72C, 72K, 72E, 72F, that correspond respectively to the toner colors of yellow (Y), magenta (M), cyan (C), black (K), a first special color (E), a second special color (F), are disposed so as to be lined-up in the peripheral direction (in that order in the counter-clockwise direction). Due to the developing device 70 being rotated each time by the central angle of 60° by a motor (not shown) that is a rotating device, the developing unit 72Y, 72M, 72C, 72K, 72E, 72F that is to carry out developing processing is switched and faces the outer peripheral surface of the photoreceptor 62. The position facing the outer peripheral surface of the photoreceptor 62 is the developing position at which developing processing is carried out. Note that, because the developing units 72Y, 72M, 72C, 72K, 72E, 72F have similar structures, here, the developing unit 72Y is described, and description of the other developing units 72M, 72C, 72K, 72E, 72F is omitted.

A developer (not shown), that is formed from a carrier and a toner supplied from a toner cartridge 78Y (see FIG. 1) via a toner supply path (not illustrated), is filled within the developing unit 72Y. The developing unit 72Y has a developing roller 74 whose outer peripheral surface faces the outer peripheral surface of the photoreceptor 62.

The developing roller 74 conveys the developer layer of the outer peripheral surface of a developing sleeve 74A to the position facing the photoreceptor 62, and adheres the toner to the latent image (electrostatic latent image) formed on the outer peripheral surface of the photoreceptor 62, and carries out developing.

The six developing rollers 74 provided at the developing units 72Y, 72M, 72C, 72K, 72E, 72F respectively are disposed in the peripheral direction such that the interval between the developing roller 74 and the adjacent developing roller 74 is the central angle of 60°. By switching the developing unit 72, the next developing roller 74 faces the outer peripheral surface of the photoreceptor 62.

An intermediate transfer belt 68, onto which is transferred the toner images formed on the outer peripheral surface of the photoreceptor 62, is provided at the downstream side of the developing device 70 in the rotating direction of the photoreceptor 62 and beneath the photoreceptor 62. The intermediate transfer belt 68 is endless, and is trained around a driving roller 61 that is rotated and driven by the control section 20, a tension imparting roller 63 for imparting tension to the intermediate transfer belt 68, plural conveying rollers 65 that contact the reverse surface of the intermediate transfer belt 68 and are slave-rotated, and an auxiliary roller 69 that, at a secondary transfer position that is described below, contacts the reverse surface of the intermediate transfer belt 68 and is slave-rotated. Due to the driving roller 61 rotating, the intermediate transfer belt 68 circulates in an arrow –R direction (counter-clockwise in FIG. 2).

A primary transfer roller 67, that primarily transfers onto the intermediate transfer belt 68 the toner images that are formed on the outer peripheral surface of the photoreceptor 62, is provided at the opposite side of the photoreceptor 62 with the intermediate transfer belt 68 nipped therebetween. The primary transfer roller 67 contacts the reverse surface of the intermediate transfer belt 68 at a position that is apart, at the downstream side in the moving direction of the intermediate transfer belt 68, from the position at which the photoreceptor 62 and the intermediate transfer belt 68 contact. Due to the primary transfer roller 67 being energized from an unillustrated power supply, the toner image of the photoreceptor 62 is primarily-transferred onto the intermediate transfer belt 68 due to the potential difference between the primary transfer roller 67 and the photoreceptor 62 that is grounded.

A secondary transfer roller 71, that serves as an example of a transfer device that secondarily-transfers onto the recording sheet P the toner images that were primarily-transferred onto the intermediate transfer belt 68, is provided at the opposite side of the auxiliary roller 69 with the intermediate transfer belt 68 nipped therebetween. The region between the secondary transfer roller 71 and the auxiliary roller 69 is the secondary transfer position at which the toner images are transferred onto the recording sheet P. The secondary transfer roller 71 contacts the obverse of the intermediate transfer belt 68. Due to the secondary transfer roller 71 being energized from an unillustrated power supply, the toner images of the intermediate transfer belt 68 are secondarily-transferred onto the recording sheet P due to the potential difference between the secondary transfer roller 71 and the auxiliary roller 69 that is grounded.

A cleaning device 100, that serves as an example of a developer recovery device that recovers the residual toner after the secondary transfer of the intermediate transfer belt 68, is provided at the opposite side of the driving roller 61 with the intermediate transfer belt 68 nipped therebetween. At the cleaning device 100, a cleaning blade 106 contacts the intermediate transfer belt 68 and scrapes-off toner. The cleaning blade 106 of the cleaning device 100 and the secondary transfer roller 71 are apart from the outer peripheral surface of the intermediate transfer belt 68 until the toner images of the respective colors are to be multiple (primarily) transferred onto the intermediate transfer belt 68 and are to be secondarily-transferred onto the recording sheet P.

A position detecting sensor 83 is provided at the periphery of the intermediate transfer belt 68 at a position facing the tension imparting roller 63. By sensing a mark (not shown) that is applied to the obverse of the intermediate transfer belt 68, the position detecting sensor 83 detects a predetermined reference position on the intermediate transfer belt 68, and outputs a position detection signal that is a reference for the start timing of the image formation processing.

A cleaning device 73, that cleans the residual toner and the like that remain on the obverse of the photoreceptor 62 without having been primarily-transferred onto the intermediate transfer belt 68, is provided at the downstream side of the primary transfer roller 67 in the rotating direction of the photoreceptor 62. The cleaning device 73 is a structure that recovers the residual toner and the like by a cleaning blade and a brush roller that contact the surface of the photoreceptor 62. Further, a charge removing device 81, that removes the charging history of the primary transfer roller by discharge to the outer peripheral surface of the photoreceptor 62, is provided at the upstream side of the cleaning device 73 in the rotating direction of the photoreceptor 62 (at the downstream side of the primary transfer roller 67). The charge removing device 81 is for carrying out negative discharging on the outer peripheral surface of the photoreceptor 62 before the residual toner and the like are recovered by the cleaning device 73, and removing the history of positive charging by the primary transfer roller, such that the previous charging does not affect the next image formation. Further, a charge erasing device 75, that irradiates light onto the outer peripheral surface of the photoreceptor 62 and cancels the history of negative charging, is provided at the downstream side of the cleaning device 73 and the upstream side of the charging device 64.

As shown in FIG. 1, the secondary transfer position of the toner images by the secondary transfer roller 71 is set midway along the conveying path 28. A fixing device 80, that fixes toner images onto the recording sheet P onto which the toner images have been transferred by the secondary transfer roller 71, is provided at the downstream side of the secondary transfer roller 71 in the conveying direction (illustrated by arrow A) of the recording sheet P on the conveying path 28. The fixing device 80 is structured by a heating roller 82, that is disposed at the toner image surface side (upper side) of the recording sheet P and has a heat source that generates heat by energization, and a pressure-applying roller 84, that is disposed at the lower side of the heating roller 82 and applies pressure to the recording sheet P toward the outer peripheral surface of the heating roller 82. Note that conveying rollers 39, that convey the recording sheet P toward the sheet ejecting section 15 or the inverting portion 33, are provided at the downstream side of the fixing device 80 in the conveying direction of the recording sheet P at the conveying path 28.

On the other hand, the toner cartridges 78Y, 78M, 78C, 78K, 78E, 78F, that house the respective toners of yellow (Y), magenta (M), cyan (C), black (K), the first special color (E), the second special color (F), are replaceably provided so as to be lined-up in the horizontal direction, at the lower side of the document reading device 56 and the upper side of the developing device 70. The first special color E and the second special color F are selected from special colors (including transparent) other than yellow, magenta, cyan, black, or are not selected. At the developing device 70, if the first special color E and the second special color F are selected, image formation in the six colors of Y, M, C, K, E, F is carried out. If the first special color E and the second special color F are not selected, image formation in the four colors of Y, M, C, K is carried out. Note that, in the present exemplary embodiment, description is given, as an example, of a case in which image formation is carried out in the six colors of Y, M, C, K, E, F. However, as another example, image formation may be carried out in five colors by using the four colors of Y, M, C, K and either the first special color E or the second special color F.

Structure of Charging Device 64

The structure of the charging device 64 is described next.

As shown in FIG. 2, the charging device 64 has a shield case 64A that is made of aluminum and whose photoreceptor 62 side is open. The shield case 64A is shaped as a long, thin box that extends along the rotational axis direction of the photoreceptor 62. A partitioning plate 64D, that partitions the interior of the shield case 64A at the transverse direction central portion thereof, is provided within the shield case 64A.

Discharge wires 64B, 64G, that serve as examples of plural discharge portions, are provided along the rotational axis direction of the photoreceptor 62 within the shield case 64A at the both sides of the partitioning plate 64D. The discharge wires 64B, 64G are structured by metal wires made of tungsten or the like. Note that the discharge portion may be a discharge member that is structured by a wire covered by resin, or a plate-shaped metal plate, or the like, and it suffices for the discharge portion to carry out discharging.

Due to voltage being applied to the discharge wires 64B, 64G from a power supply (not shown), the discharge wires 64B, 64G carry out the discharging operation of generating negative charges and supplying the negative charges to the surface of the photoreceptor 62. The photoreceptor 62 is charged by this discharging operation.

A control substrate 64E, that serves as an example of a control section that controls the application of voltage to the discharge wires 64B, 64G and the stopping thereof (ON/OFF) respectively, is connected to the discharge wires 64B, 64G. The execution and the stopping of the discharging operations of the discharge wires 64B, 64G are controlled by the control substrate 64E controlling the application of voltage to the discharge wires 64B, 64G and the stopping thereof (ON/OFF).

A grid 64C having plural openings is disposed along the rotational axis direction of the photoreceptor 62, at the opening side of the shield case 64A and between the photoreceptor 62 and the discharge wires 64B, 64G.

The control substrate 64E is connected to the grid 64C, and controls grid voltage that is applied from the power supply (not shown). Namely, the control substrate 64E functions as an example of a control section for the grid that controls the grid voltage. Note that the control section for the grid, that controls the grid voltage, and the control section, that controls the execution and stopping of the discharging operations of the discharge wires 64B, 64G, may be provided separately.

At the grid 64C, the negative charges generated at the discharge wires 64B, 64G pass through the openings of the grid 64C and are supplied to the photoreceptor 62. The passage amount of the negative charges that pass through the grid 64C is controlled by the grid voltage that is controlled by the control substrate 64E. The charge potential of the photoreceptor 62 is thereby controlled.

Concretely, when the voltage (potential) of the grid 64C is high with respect to the potential of the photoreceptor 62, the negative charges head toward the photoreceptor 62 due to this potential difference, and therefore, the passage amount of the negative charges is large. When the potential difference between the photoreceptor 62 and the grid 64C becomes small due to the negative charges being supplied to the photoreceptor 62, the passage amount of the negative charges decreases. Accordingly, by setting the grid voltage of the grid 64C to be high, the passage amount of the negative charges increases and the charge potential of the photoreceptor 62 becomes high, more so than in a case in which the grid voltage is set to be low.

Figure 3:
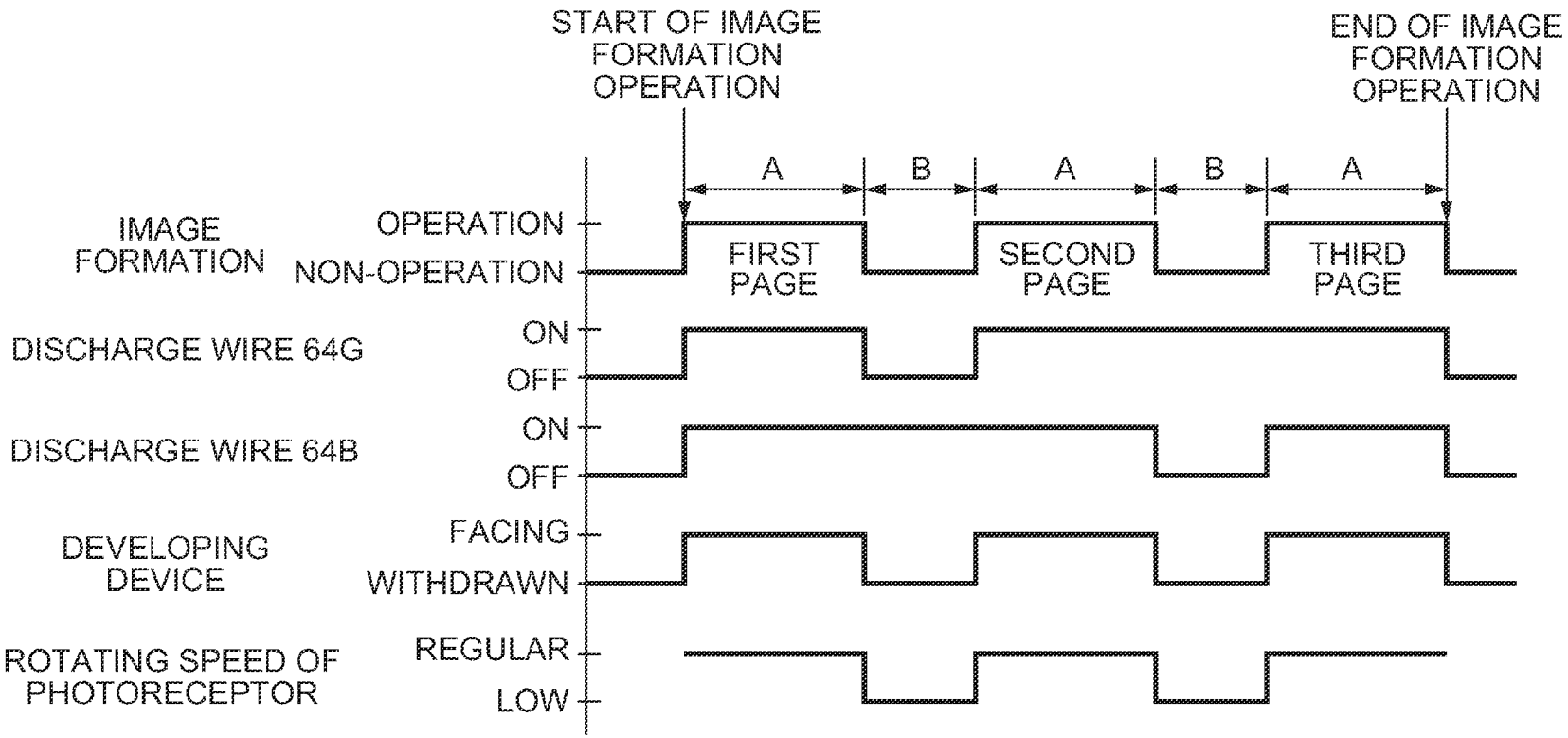
FIG. 3 is a chart showing the operating states of respective sections in image formation operation sections and image formation non-operation sections relating to the present exemplary embodiment.

Here, as shown in FIG. 3, in the present exemplary embodiment, the image forming device 10 acquires an image formation instruction. During the time period from the start to the end of the series of image formation operations that are based on this instruction, the two discharge wires 64B, 64G both execute the discharging operation by the control substrate 64E in image formation operation sections (image formation regions) A (hereinafter simply called operation sections A) in which toner images are formed on the photoreceptor 62.

Concretely, for example, when an image formation instruction to form images on plural pages of the recording sheets P is acquired, the sections in which the toner images, that are to be transferred onto the respective pages of the recording sheets P, are formed on the photoreceptor 62 are the operation sections A. Note that the forming of images onto plural pages of the recording sheets P includes cases of forming images on one sides of the plural recording sheets P, and cases of forming images on both sides of the one or plural recording sheets P.

During the time period from the start to the end of the series of image formation operations that are based on an image formation instruction, only one of the two discharge wires 64B, 64G executes the discharging operation by the control substrate 64E in image formation non-operation sections (non image formation regions) B (hereinafter simply called non-operation sections B) in which toner images are not formed on the photoreceptor 62. In this execution of the discharging operation, the discharge wire 64B, 64G that carries out the discharging operation switches alternately at each non-operation section B.

Concretely, when an image formation instruction for forming images on ones of surfaces of plural recording sheets P is acquired, the operation section A, in which the toner images that are to be transferred onto the specific recording sheet P are formed on the photoreceptor 62, ends, and the section until the start of the operation section A, in which the toner images that are to be transferred onto the next recording sheet P are formed on the photoreceptor 62, is the non-operation section B.

Further, when an image formation instruction to form images on both surfaces of plural recording sheets P is acquired, the operation section A, in which the toner images that are to be transferred onto the obverse of the recording sheet P are formed on the photoreceptor 62, ends, and the section until the start of the operation section A, in which the toner images that are to be transferred onto the reverse of that recording sheet P (or the obverse of the next recording sheet P) are formed on the photoreceptor 62, is the non-operation section B. Moreover, the operation section A, in which the toner images that are to be transferred onto the reverse of the recording sheet P are formed on the photoreceptor 62, ends, and the section until the start of the operation section A, in which the toner images that are to be transferred onto the obverse of the next recording sheet P are formed on the photoreceptor 62, is the non-operation section B.

Control of Discharging Operation of Discharge Wires 64B, 64G

An example of control of the discharging operations of the discharge wires 64B, 64G in the image formation operation of the image forming device 10 is described next. Here, description is given of a case in which the image forming device 10 acquires an image formation instruction to form images on three pages of the recording sheets P. Note that three pages of the recording sheets P here means three single sides of the recording sheets P.

When the image forming device 10 acquires the image formation instruction, the photoreceptor 62 starts rotating. The two discharge wires 64B, 64G execute discharging operations by the control substrate 64E such that the charging device 64 charges the photoreceptor 62.

The light, that is emitted from the exposure device 66 in accordance with the yellow image data, exposes the outer peripheral surface (the surface) of the photoreceptor 62 that has been charged by the charging device 64, and an electrostatic latent image corresponding to the yellow image data is formed on the surface of the photoreceptor 62. The electrostatic latent image formed on the surface of the photoreceptor 62 is developed as a yellow toner image by the developing unit 72Y that is positioned at the developing position. Then, the yellow toner image on the surface of the photoreceptor 62 is transferred onto the intermediate transfer belt 68 by the primary transfer roller 67.

Next, the developing device 70 is rotated 60° in the arrow +R direction, and the developing unit 72M moves to the developing position facing the photoreceptor 62. Next, the two discharge wires 64B, 64G carry out the discharging operations by the control substrate 64E such that the charging device 64 charges the photoreceptor 62. Then, due to the respective processes of exposure and development being carried out, a magenta toner image is formed on the surface of the photoreceptor 62. The magenta toner image on the surface of the photoreceptor 62 is transferred onto the yellow toner image of the intermediate transfer belt 68 by the primary transfer roller 67.

In forming the toner images of cyan (C), black (K), the first special color (E) and the second special color (F) as well, the developing device 70 is rotated 60° in the arrow +R direction, and the two discharge wires 64B, 64G execute the discharging operation by the control substrate 64E such that the charging device 64 charges the photoreceptor 62. Then, in the same way as described above, the respective processes of exposure and development are carried out, and toner images of cyan (C), black (K), the first special color (E) and the second special color (F) are formed on the photoreceptor 62. The toner images of the respective colors on the photoreceptor 62 are successively transferred onto the intermediate transfer belt 68 so as to be superposed one on another. Due thereto, the toner images of one page that is the first page recording sheet P are formed.

On the other hand, the first recording sheet P, that is sent-out from the sheet accommodating portion 12 and conveyed-in along the conveying path 28, is conveyed to the second transfer position with the timing thereof made, by the registration rollers 38, to conform to the superposed transfer of the respective toner images onto the intermediate transfer belt 68. Then, the toner images that have been transferred in a superposed manner on the intermediate transfer belt 68 are secondarily-transferred, by the secondary transfer roller 71, onto the first recording sheet P that is conveyed to the secondary transfer position.

Then, the recording sheet P, on which the toner images have been transferred, is conveyed in the arrow A direction (rightward in the drawing) toward the fixing device 80. At the fixing device 80, the toner images are fixed onto the recording sheet P by heat and pressure being applied thereto by the heating roller 82 and the pressure-applying roller 84. Further, the recording sheet P, on which the toner images have been fixed, is ejected out to the sheet ejecting section 15.

In this way, in the operation section A in which the toner images of the six colors, that correspond to one page that is the first page recording sheet P, are successively formed on the photoreceptor 62, the two discharge wires 64B, 64G execute the discharging operation by the control substrate 64E as shown in FIG. 3.

Here, even after the toner images of the first page have been transferred onto the intermediate transfer belt 68, the photoreceptor 62 continues to rotate until the toner images of the third page are transferred onto the intermediate transfer belt 68.

After the toner image of the sixth color of the first page is formed at the photoreceptor 62, in non-operation section B that is until the toner image of the first color of the second page begins to be formed on the photoreceptor 62, the developing device 70 is withdrawn from the developing position and stopped. Concretely, the developing device 70 is rotated, for example, 30° in the arrow +R direction from the position where the developing roller 74 of the developing unit 72F faces the photoreceptor 62, and faces the photoreceptor 62 between the developing unit 72F and the developing unit 72Y. Namely, the developing device 70 stops at a withdrawn position at which the developing rollers 74 are offset from and do not face the photoreceptor 62. Due thereto, electrostatic attraction of the developers of the developing device 70 to the photoreceptor 62 is suppressed.

Further, in the non-operation section B, the rotational speed of the photoreceptor 62 decreases in accordance with a decrease in the fixing speed at the fixing device 80 (the speed of conveying by the heating roller 82 and the pressure-applying roller 84). Due thereto, the negative charges per unit surface area that are supplied from the charging device 64 to the photoreceptor 62 increase. Note that a decrease in the fixing speed at the fixing device 80 concretely is carried out in cases of fixing the toner images to thick paper at which it is difficult for toner images to be fixed, and cases of bringing-out gloss in the toner images that are fixed to the recording sheet P.

In the non-operation section B, of the two discharge wires 64B, 64G, only the discharging operation of the discharge wire 64B is executed by the control substrate 64E, and the charging device 64 charges the photoreceptor 62. Due thereto, in non-operation section B, the negative charges that are supplied from the charging device 64 to the photoreceptor 62 are reduced as compared with in operation section A. However, due to the decrease in the rotating speed of the photoreceptor 62, the negative charges per unit surface area that are supplied from the charging device 64 to the photoreceptor 62 increase, and therefore, a decrease in the charge potential of the photoreceptor 62 is suppressed.

Further, even when the charge potential of the photoreceptor 62 in non-operation section B is low as compared with in operation section A, by charging the photoreceptor 62, as compared with a case in which the photoreceptor 62 is not charged, it is difficult for the developers of the developing device 70 and the developers floating in the periphery of the photoreceptor 62 to be electrostatically attracted, and further, there is preliminary charging for the next operation section A, and the productivity improves. Moreover, even when the charge potential of the photoreceptor 62 in non-operation section B is low as compared with in operation section A, in non-operation section B, a toner image is not formed on the photoreceptor 62, and further, it is difficult for the developers to be electrostatically attracted to the photoreceptor 62 due to the withdrawing of the developing device 70. Therefore, it is difficult for effects due to the charge potential being low to be exhibited.

Next, when image formation of the second page recording sheet P is started, in the same way as described above, the respective processes of charging, exposure and development are carried out, and toner images of the six colors are successively formed on the photoreceptor 62. The toner images of the six colors are successively transferred onto the intermediate transfer belt 68 so as to be superposed one on another. Due thereto, toner images of the one page that is the second page recording sheet P are formed.

Also in the charging process at the time of forming the toner images of the one page that is the second page recording sheet P, the two discharge wires 64B, 64G carry out discharging operations by the control substrate 64E such that the charging device 64 charges the photoreceptor 62.

The toner images, that have been transferred onto the intermediate transfer belt 68 in a superposed manner, are secondarily-transferred, by the secondary transfer roller 71, onto the second recording sheet P that is sent-out from the sheet accommodating section 12 and conveyed to the secondary transfer position. The toner images are fixed by the fixing device 80 onto the recording sheet P on which the toner images have been secondarily transferred, and the recording sheet P is ejected to the sheet ejecting section 15.

After the toner image of the sixth color of the second page is formed on the photoreceptor 62, in non-operation section B that is until the toner image of the first color of the third page begins to be formed on the photoreceptor 62, the developing device 70 is withdrawn from the developing position and stopped in the same way as described above. Further, in this non-operation section B, the rotational speed of the photoreceptor 62 decreases in accordance with a decrease in the fixing speed at the fixing device 80 (the speed of conveying by the heating roller 82 and the pressure-applying roller 84).

In the non-operation section B, of the two discharge wires 64B, 64G, only the discharging operation of the discharge wire 64G is executed by the control substrate 64E, and the charging device 64 charges the photoreceptor 62. Namely, in this non-operation section B, discharging operation is executed by switching to the discharge wire 64G from the discharge wire 64B that executed the discharging operation in the non-operation section B of the previous time.

Next, when image formation of the third page recording sheet P is started, in the same way as described above, the respective processes of charging, exposure and development are carried out, and toner images of the six colors are successively formed on the photoreceptor 62. The toner images of the six colors are successively transferred onto the intermediate transfer belt 68 so as to be superposed one on another. Due thereto, toner images of the one page that is the third page recording sheet P are formed.

Also in the charging process at the time of forming the toner images of the one page that is the third page recording sheet P, the two discharge wires 64B, 64G execute the discharging operation by the control substrate 64E such that the charging device 64 charges the photoreceptor 62.

The toner images, that have been transferred onto the intermediate transfer belt 68 in a superposed manner, are secondarily-transferred, by the secondary transfer roller 71, onto the third recording sheet P that is sent-out from the sheet accommodating section 12 and conveyed to the secondary transfer position. The toner images are fixed by the fixing device 80 onto the recording sheet P on which the toner images have been secondarily transferred, and the recording sheet P is ejected to the sheet ejecting section 15. Due thereto, the image formation based on the image formation instruction ends.

Note that, when the image formation instruction to form images on three pages of the recording sheets P includes image formation on both surfaces of the recording sheet P, the toner images of the second page or the third page are formed on the reverse of the recording sheet P. At this time, the recording sheet P, on which the toner images of the first page or the second page are formed on one side thereof, is not conveyed to the sheet ejecting section 15, and is inverted at the inverting portion 33 and again conveyed to the secondary transfer position.

Figure 4:
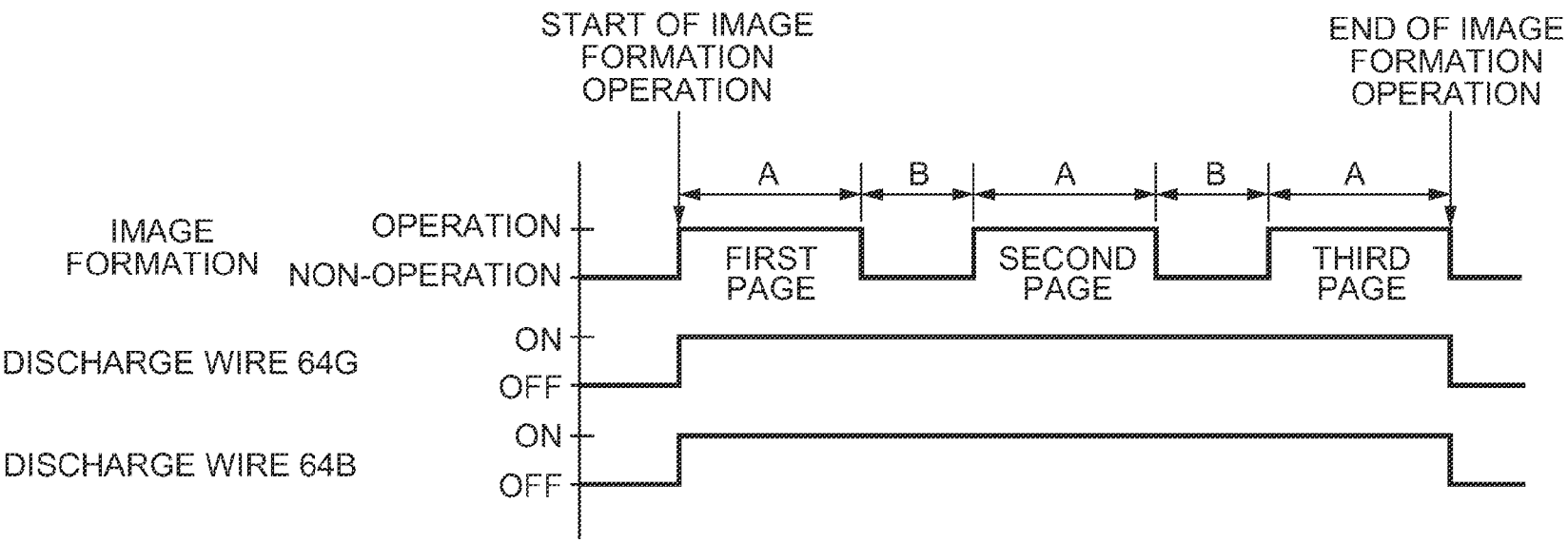
FIG. 4 is a chart showing the operating states of respective sections in image formation operation sections and image formation non-operation sections relating to a comparative example.
Figure 5:
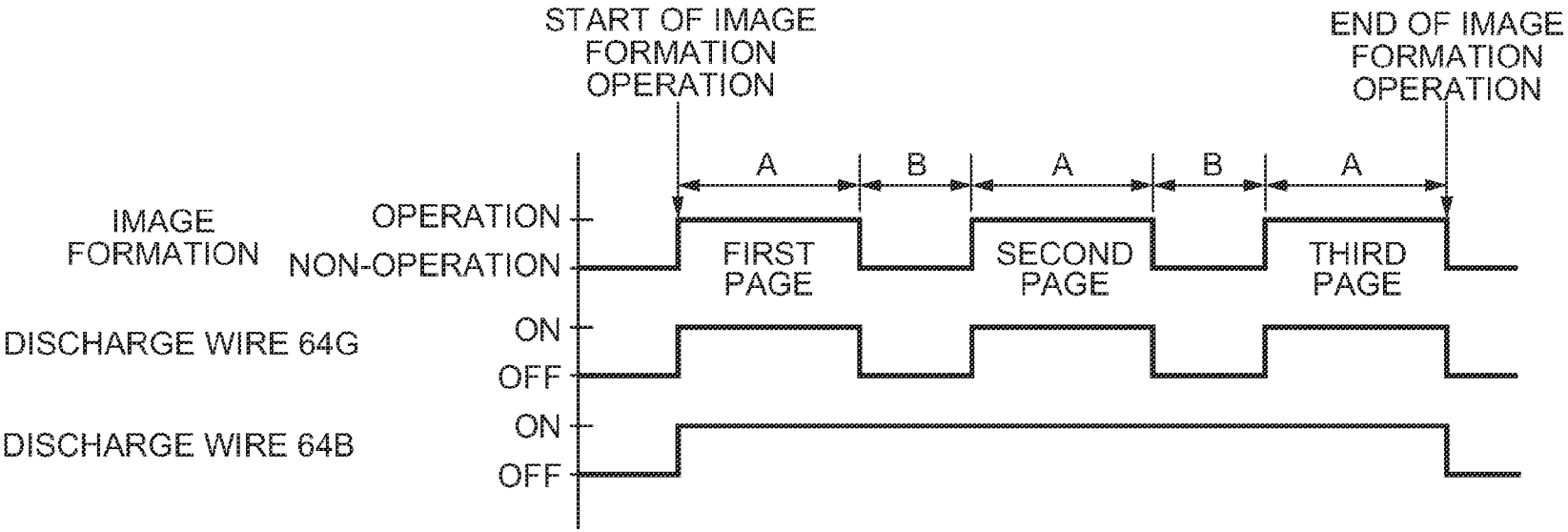
FIG. 5 is a chart showing the operating states of respective sections in image formation operation sections and image formation non-operation sections relating to a comparative example.

As described above, in the present exemplary embodiment, in the non-operation sections B, the discharge wires 64B, 64G are alternately switched, and the discharging operation of one of the discharge wires 64B, 64G is executed. Therefore, the respective discharging times of the discharge wires 64B, 64G are curbed. Due thereto, the life of the charging device 64 overall is lengthened, as compared with, for example, a structure in which discharging operations of both of the discharge wires 64B, 64G are executed in the non-operation intervals B (see FIG. 4), and a structure in which the discharging operation of only the discharge wire 64B is executed without switching in the non-operation intervals B (see FIG. 5).

Note that, in the present exemplary embodiment, in the non-operation sections B, one of the discharge wires 64B, 64G executes the discharging operation, and the other is stopped. However, the charging device 64 may be structured such that one of the discharge wires 64B, 64G executes the discharging operation, and the output of the other is decreased. A state in which the output of the other of the discharge wires 64B, 64G is reduced is a state in which the load on the other of the discharge wires 64B, 64G is reduced, and is, for example, a case in which the applied voltage of the discharge wire 64B, 64G or the wire current flowing through the discharge wire 64B, 64G is reduced by control of the control substrate 64E.

Figure 6:
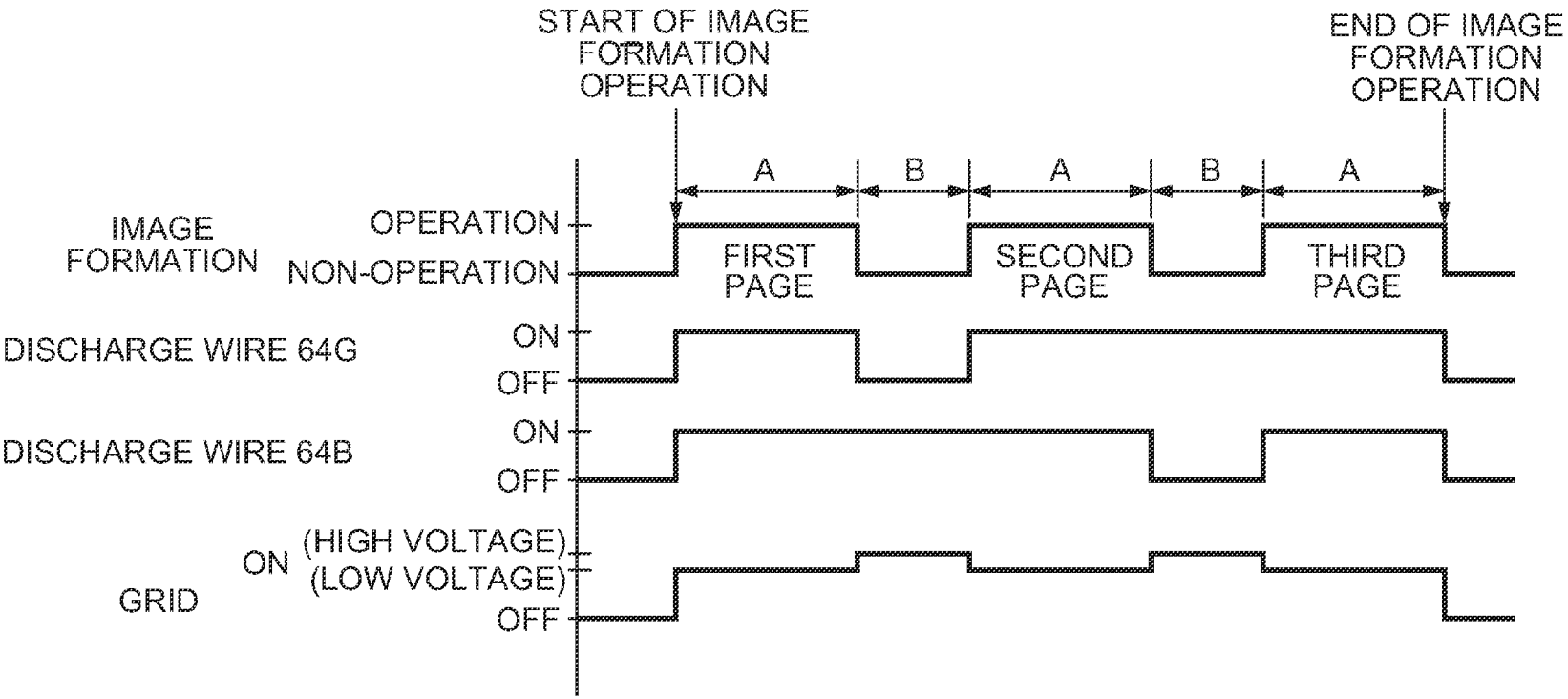
FIG. 6 is a chart showing the operating states of respective sections in image formation operation sections and image formation non-operation sections relating to a modified example.

Further, as shown in FIG. 6, in the non-operation sections B in which the discharging operation of one of the discharge wires 64B, 64G is carried out, a grid voltage that is higher than in operation sections A may be applied to the grid 64C by the control substrate 64E. Due thereto, the passage amount of the negative charges, that pass through the grid 64C from the discharge wire 64B, 64G toward the photoreceptor 62, increases, and the difference in the charge potential of the photoreceptor 62 between the non-operation sections B and the operation sections A is small.

Figure 7:
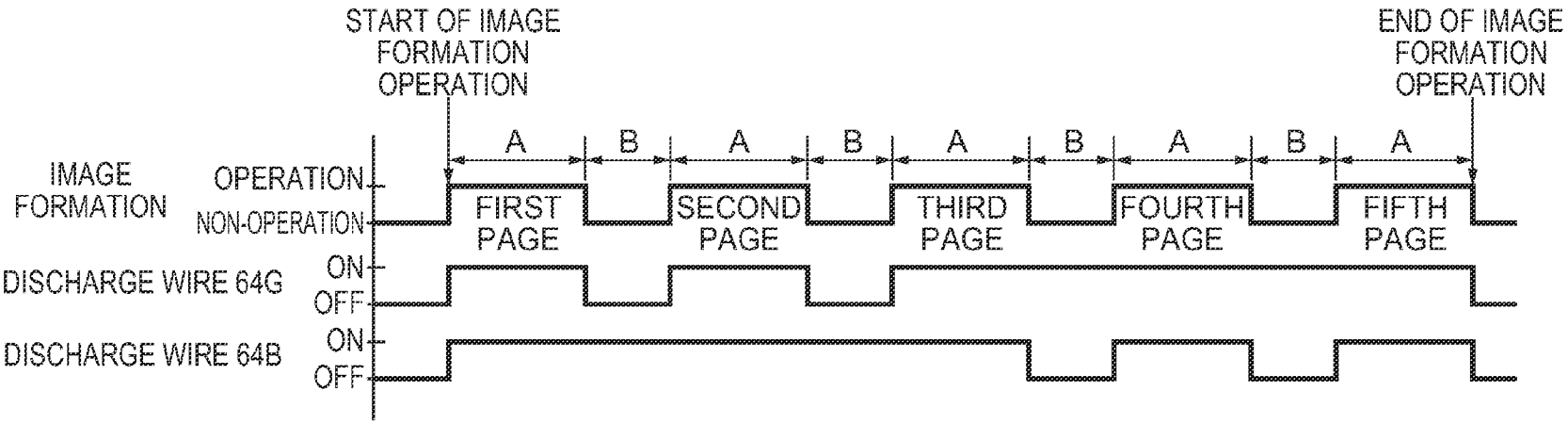
FIG. 7 is a chart showing the operating states of respective sections in image formation operation sections and image formation non-operation sections relating to a modified example.

Moreover, in the present exemplary embodiment, in the non-operation sections B, the discharge wires 64B, 64G are alternately switched, and the discharging operation of one of the discharge wires 64B, 64G is executed. However, there is no need for switching each time the non-operation section B arrives. For example, as shown in FIG. 7, the discharging operation of the discharge wire 64B may be executed in the first and second non-operation sections B, and the discharging operation of the discharge wire 64G may be executed in the third and fourth non-operation sections B. Namely, it suffices for the switching operation to be carried out so as to, overall, not be one-sided toward either one of the discharge wires 64B, 64G.

The charging device 64 is structured to have the two discharge wires 64B, 64G in the present exemplary embodiment, but may be structured to have three or more discharge portions as the discharge portions. In this case, in the operation sections A, the discharging operations of all of the three or more discharge portions are executed, and, in the non-operation sections B, the discharging operations of the discharge portions are carried out by switching between "some of the three or more discharge portions" and "some others of the three or more discharge portions".

Note that, "others" in the "some others of the three or more discharge portions" means not having to be exactly the same as the "some of the three or more discharge portions", and common discharge portions may be included in the "some of the three or more discharge portions" and the "some others of the three or more discharge portions". Accordingly, for example, in the case of the charging device 64 that has three discharge wires 64I, 64B, 64G as shown in FIG. 8, as shown in FIG. 9, discharging operations may be executed by the discharge wires 64I, 64B in the first non-operation section B, and discharging operations may be executed by the discharge wires 64I, 64G in the second non-operation section B, and discharging operations may be executed by the discharge wires 64B, 64G in the third non-operation section B, and discharging operations may be executed by the discharge wires 64I, 64B in the fourth non-operation section B.

Figure 10:
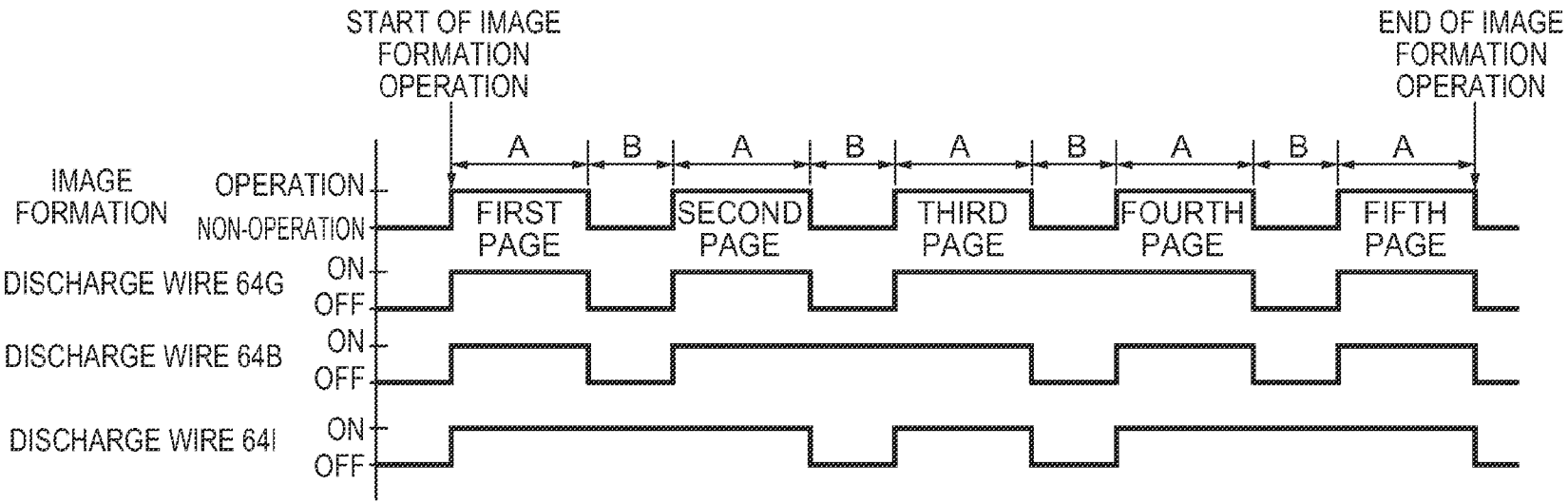
FIG. 10 is a chart showing the operating states of respective sections in image formation operation sections and image formation non-operation sections in the charging device shown in FIG. 8.
Figure 11:
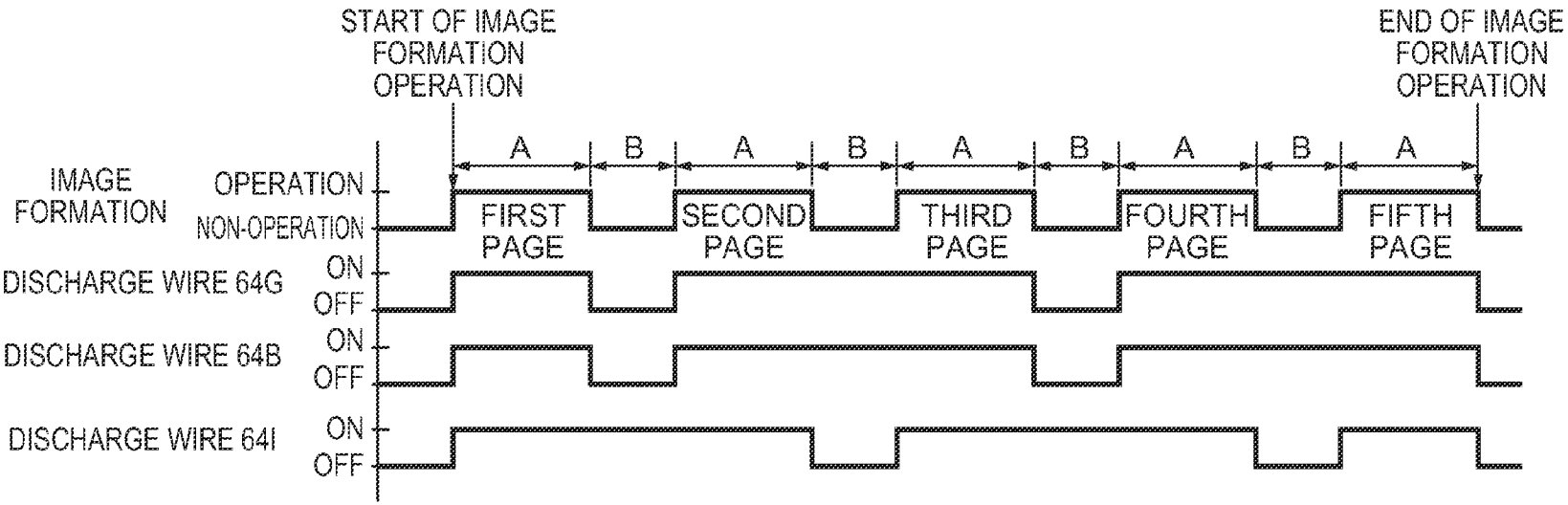
FIG. 11 is a chart showing the operating states of respective sections in image formation operation sections and image formation non-operation sections in the charging device shown in FIG. 8.

Further, as shown in FIG. 10, a discharging operation may be executed by only the discharge wire 64I in the first non-operation section B, and a discharging operation may be executed by only the discharge wire 64B in the second non-operation section B, and a discharging operation may be executed by only the discharge wire 64G in the third non-operation section B, and a discharging operation may be executed by only the discharge wire 64I in the fourth non-operation section B. Moreover, as shown in FIG. 11, a discharging operation may be executed by only the discharge wire 64I in the first non-operation section B, and discharging operations may be executed by the discharge wires 64B, 64G in the second non-operation section B, and a discharging operation may be executed by only the discharge wire 64I in the third non-operation section B, and discharging operations may be executed by the discharge wires 64B, 64G in the fourth non-operation section B.

Figure 8:
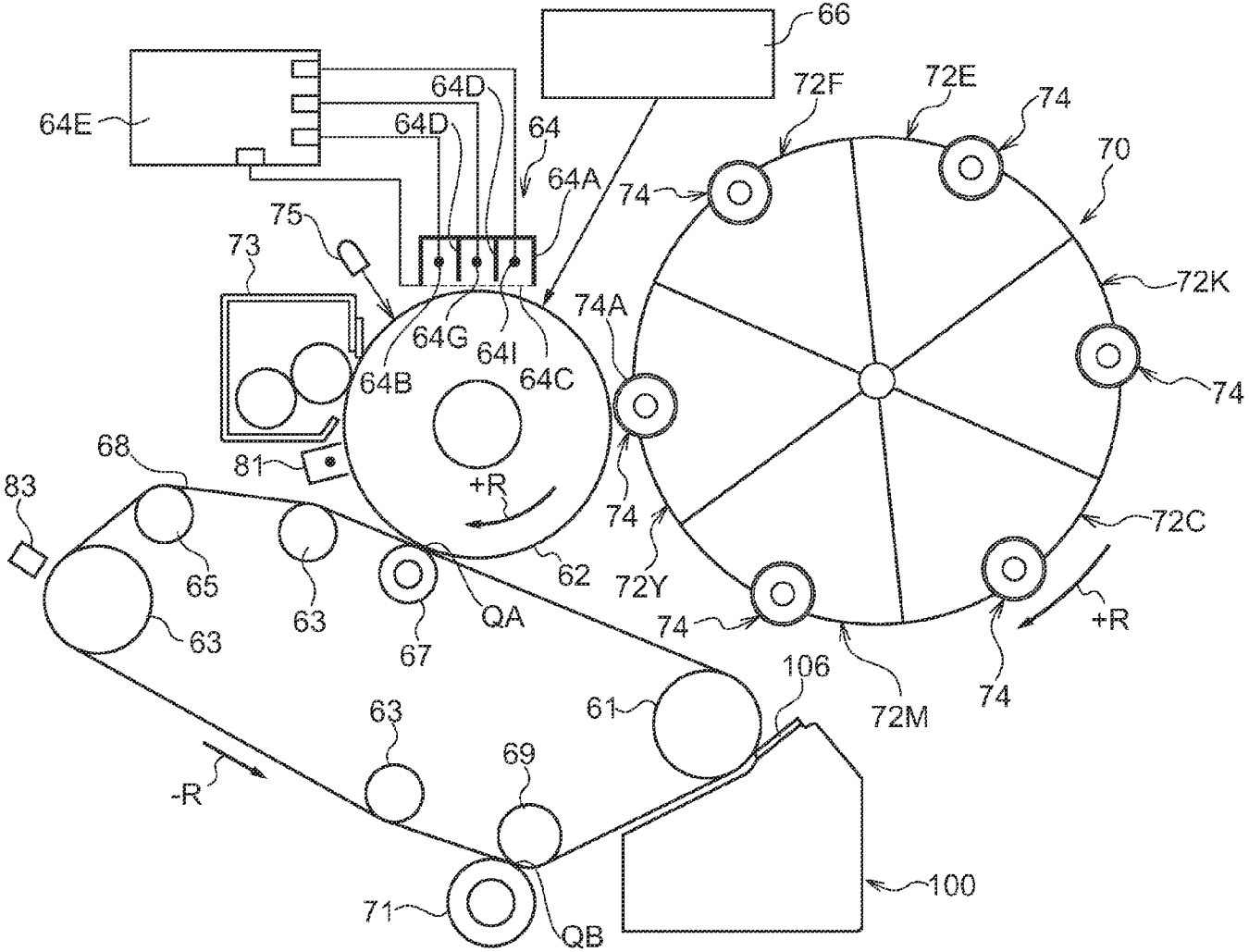
FIG. 8 is a schematic drawing showing the structure of a charging device having three discharge portions.
Figure 9:
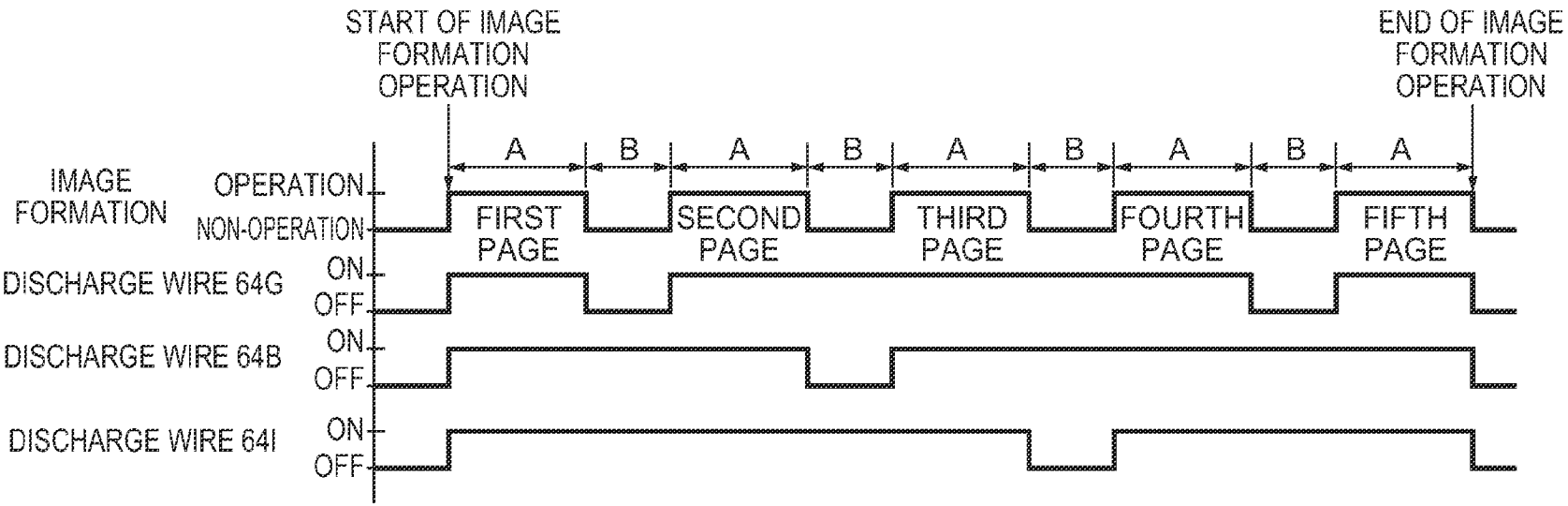
FIG. 9 is a chart showing the operating states of respective sections in image formation operation sections and image formation non-operation sections in the charging device shown in FIG. 8.

Note that, in the structure shown in FIG. 8, the control substrate 64E is respectively connected to the three discharge wires 64I, 64B, 64G. Further, the interior of the shield case 64A is divided into three sections in the transverse direction by two of the partitioning plates 64D, and the discharge wires 64I, 64B, 64G are disposed in the respective spaces.

Figure 12:
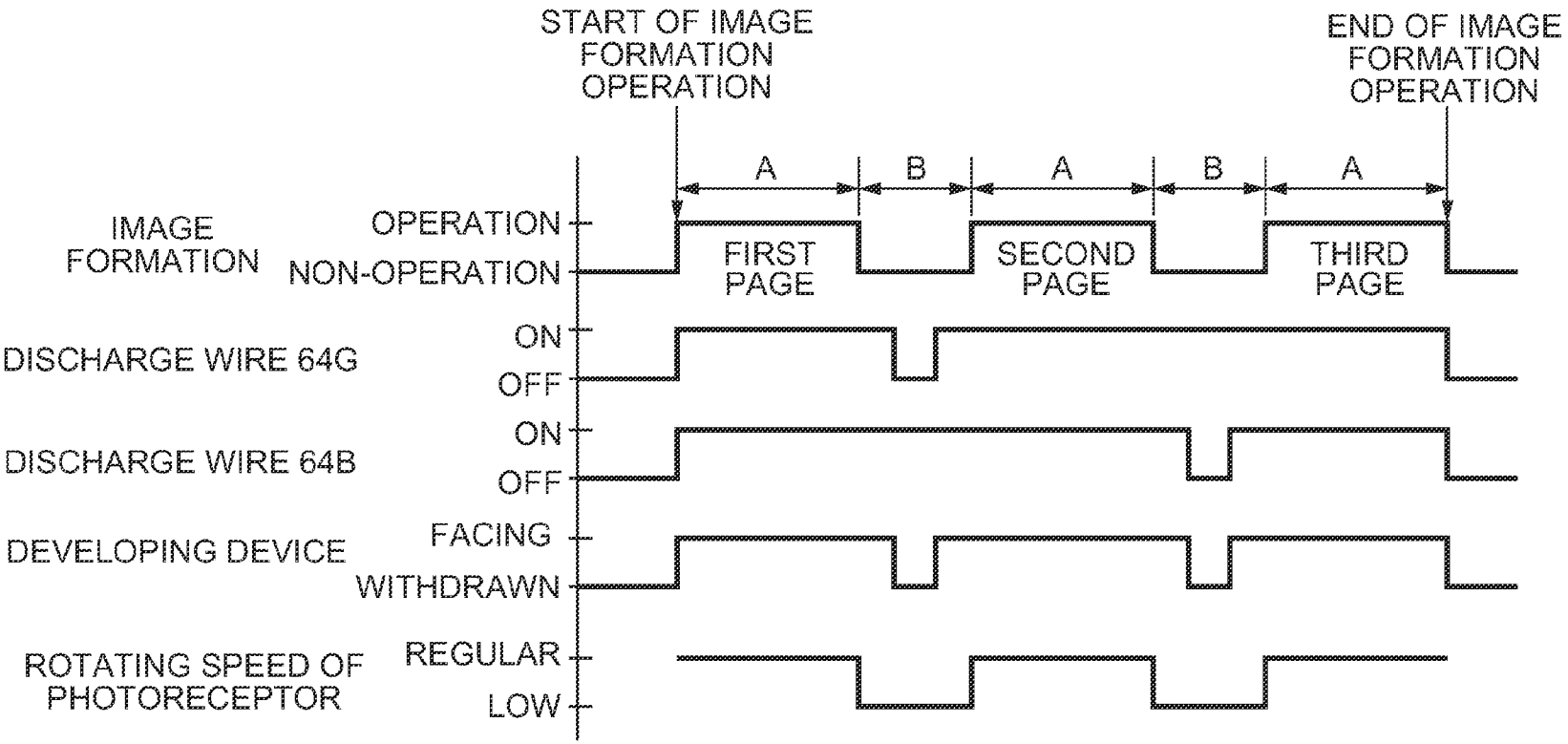
FIG. 12 is a chart showing the operating states of respective sections in image formation operation sections and image formation non-operation sections relating to a modified example.

In the present exemplary embodiment, the developing device 70 is withdrawn in the non-operation sections B, but the timing of withdrawing the developing device 70 and the non-operation sections B do not have to coincide. In this case, the timing of executing the discharging operation of one of the two discharge wires 64B, 64G may conform to the timing of the withdrawing of the developing device 70, and not conform to the non-operation sections B. For example, as shown in FIG. 12, when the developing device 70 is withdrawn during a portion of the non-operation section B, in accordance with the timing thereof, the two discharge wires 64B, 64G are switched and the discharging operation of one thereof is carried out.

Further, the rotating speed of the photoreceptor 62 decreases on the basis of a decrease in the fixing speed in the present exemplary embodiment, but does not have to be based on a decrease in the fixing speed. For example, when the rotating speed of the intermediate transfer belt 68 is lowered on the basis of the size (the length along the conveying direction) of the recording sheet P onto which images are transferred, or the like, the rotating speed of the photoreceptor 62 may be lowered on the basis of the decrease in the rotating speed of the intermediate transfer belt 68.

Figure 13:
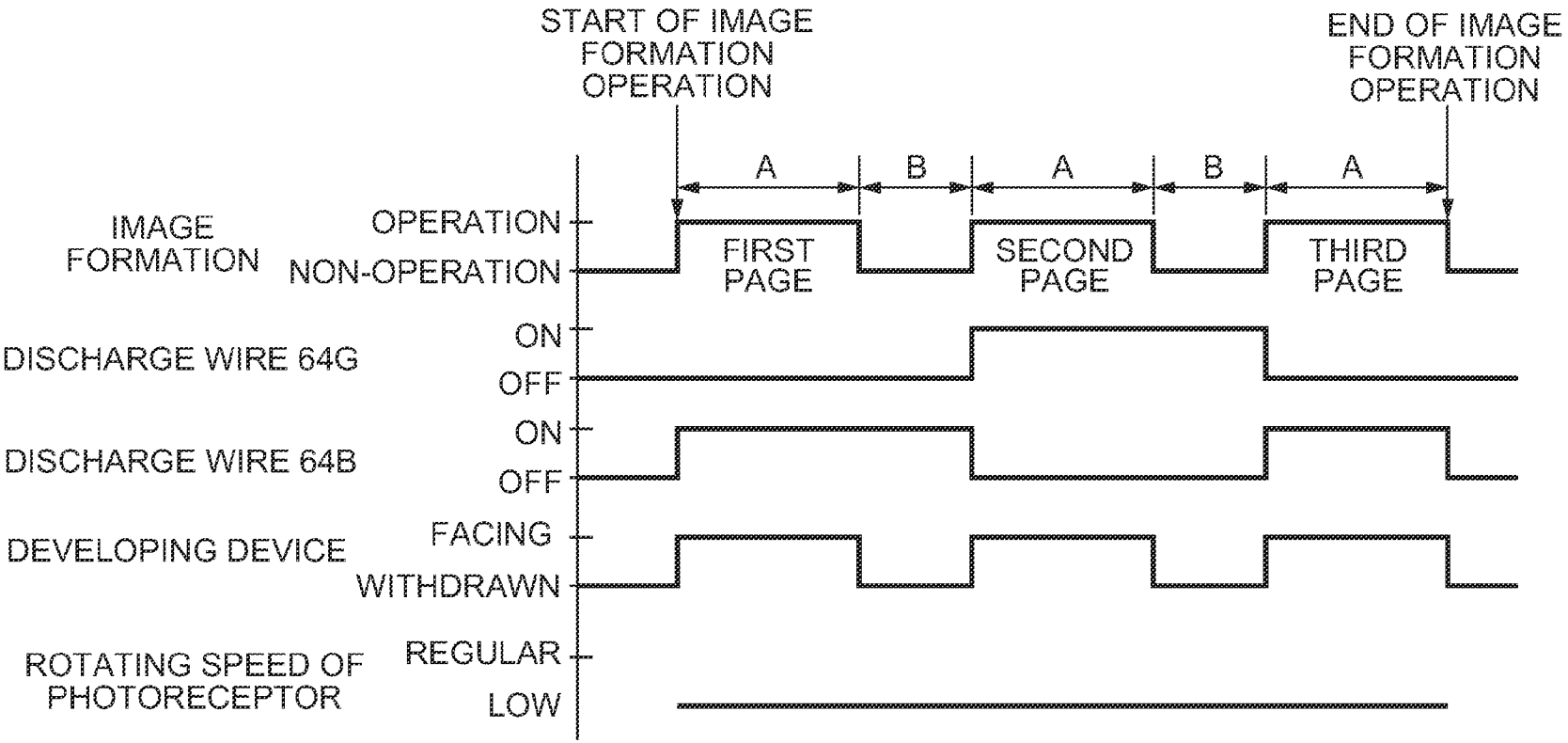
FIG. 13 is a chart showing the operating states of respective sections in image formation operation sections and image formation non-operation sections relating to a modified example.

Although the rotating speed of the photoreceptor 62 is decreased in the non-operation sections B in the present exemplary embodiment, the timing of decreasing the rotating speed of the photoreceptor 62 and the non-operation sections B do not have to coincide. In this case, the timing of executing the discharging operation of one of the two discharge wires 64B, 64G may conform to the timing of decreasing the rotating speed of the photoreceptor 62, and not conform to the non-operation sections B. For example, as shown in FIG. 13, when the rotating speed of the photoreceptor 62 is decreased in operation sections A as well, in accordance with the timing thereof, the two discharge wires 64B, 64G are switched and the discharging operation of one thereof is carried out.

Further, in the present exemplary embodiment, the developing device 70 is a structure having developing units of six colors in 60° divisions. However, for example, a developing device having developing units of four colors in 90° divisions may be provided.

In the present exemplary embodiment, the developing device 70 is withdrawn from the photoreceptor 62 by rotating the developing device 70 to a position at which the developing rollers 74 do not face the photoreceptor 62 and stopping the developing device 70 thereat. However, the withdrawing of the developing device 70 may be structured such that the entire developing device 70 is moved away from the photoreceptor 62.

Further, the image forming device 10 may be a tandem-type image forming device in which image forming units, that contain photoreceptors, developing devices, and the like, are disposed per color in a straight line along the advancing direction of the recording sheet P.

The present invention is not limited to the above-described exemplary embodiments, and various modifications, changes and improvements are possible. For example, several of the above-described modified examples may be combined together.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

an image forming body on which an image is formed in a state in which the image forming body is charged;

a charging device that has a plurality of discharge portions, and charges the image forming body by discharging of the plurality of discharge portions; and a control section that, when forming the image on the image forming body, operates the plurality of discharge portions, and when not forming the image on the image forming body, switches between a state of operating some of the plurality of discharge portions and decreasing output of or stopping the discharge portions other than the some discharge portions, and a state of operating some other of the plurality of discharge portions and decreasing output of or stopping the discharge portions other than the some other discharge portions.

2. An image forming device comprising:

an image forming body that rotates, and on which an image is formed in a state in which the image forming body is charged;

a charging device that has a plurality of discharge portions, and charges the image forming body by discharging of the plurality of discharge portions; and a control section that, when the image forming body rotates at a first rotating speed, operates the plurality of discharge portions, and when the image forming body rotates at a second rotating speed that is slower than the first rotating speed, switches between a first state of operating a first set of the plurality of discharge portions and decreasing output of or stopping the discharge portions other than the first set of discharge portions, and a second state of operating a second set of the plurality of discharge portions other than the first set of the plurality of discharge portions and decreasing output of or stopping the discharge portions other than the second set of discharge portions.

3. An image forming device comprising:

a photoreceptor on which an electrostatic latent image is formed by the photoreceptor being charged and exposed;

a charging device that has a plurality of discharge portions, and charges the photoreceptor by discharging of the plurality of discharge portions;

a developing device that develops the electrostatic latent image of the photoreceptor at a developing position; and a control section that, when the developing device is positioned at the developing position, operates the plurality of discharge portions, and when the developing device is not positioned at the developing position, switches between a state of operating some of the plurality of discharge portions and decreasing output of or stopping the discharge portions other than the some discharge portions, and a state of operating some other of the plurality of discharge portions and decreasing output of or stopping the discharge portions other than the some other discharge portions.

4. The image forming device of claim 1, further comprising:

a grid that, in accordance with applied grid voltage, controls a discharge amount from the plurality of discharge portions to the photoreceptor; and a control section for the grid that, in a state in which some or some other of the plurality of discharge portions are operating, makes the grid voltage higher than in a state in which the plurality of discharge portions are operating.

5. The image forming device of claim 2, further comprising:

a grid that, in accordance with applied grid voltage, controls a discharge amount from the plurality of discharge portions to the photoreceptor; and a control section for the grid that, in a state in which some or some other of the plurality of discharge portions are operating, makes the grid voltage higher than in a state in which the plurality of discharge portions are operating.

6. The image forming device of claim 3, further comprising:

a grid that, in accordance with applied grid voltage, controls a discharge amount from the plurality of discharge portions to the photoreceptor; and a control section for the grid that, in a state in which some or some other of the plurality of discharge portions are operating, makes the grid voltage higher than in a state in which the plurality of discharge portions are operating.

7. An image forming device comprising:

an image forming body on which an image is formed in a state in which the image forming body is charged;

a charging device that has a plurality of discharge portions, and is adapted to charge the image forming body by discharging of the plurality of discharge portions; and a control section that controls operation of the charging device, and that, with respect to image formation regions of the image forming body, operates the plurality of discharge portions, and, with respect to non image formation regions of the image forming body, switches between a state of operating some of the plurality of discharge portions and decreasing output of or stopping the discharge portions other than the some of the plurality of discharge portions, and a state of operating some other of the plurality of discharge portions and decreasing output of or stopping the discharge portions other than the some other of the plurality of discharge portions.

8. The image forming device of claim 1, wherein the charging device faces an outer surface of the image forming body.

9. The image forming device of claim 1, wherein a structure of the plurality of the discharge portions is the same.

10. The image forming device of claim 1, wherein each discharge portion comprises a shield case and a discharge wire, and a width of each of the shield cases is the same.

* * * * *